US009797281B2

(12) United States Patent
Kong et al.

(10) Patent No.: US 9,797,281 B2
(45) Date of Patent: Oct. 24, 2017

(54) FOUR-STROKE ENGINE

(71) Applicant: SUZHOU CLEVA PRECISION MACHINERY & TECHNOLOGY CO., LTD., Suzhou, Jiangsu Province (CN)

(72) Inventors: Zhao Kong, Jiangsu (CN); Ning Guo, Jiangsu (CN); Keya Feng, Jiangsu (CN)

(73) Assignee: Suzhou Cleva Precision Machinery & Technology Co., Ltd., Suzhou (CN)

( * ) Notice: Subject to any disclaimer, the term of this patent is extended or adjusted under 35 U.S.C. 154(b) by 0 days.

(21) Appl. No.: 14/899,068

(22) PCT Filed: Jun. 5, 2014

(86) PCT No.: PCT/CN2014/079236
§ 371 (c)(1),
(2) Date: Dec. 16, 2015

(87) PCT Pub. No.: WO2014/201952
PCT Pub. Date: Dec. 24, 2014

(65) Prior Publication Data

US 2016/0130994 A1 May 12, 2016

(30) Foreign Application Priority Data

Jun. 17, 2013 (CN) ..... 2013 1 0239152

(51) Int. Cl.
*F01M 1/06* (2006.01)
*F01M 9/10* (2006.01)
(Continued)

(52) U.S. Cl.
CPC ..... *F01M 9/105* (2013.01); *F01L 1/04* (2013.01); *F01L 1/06* (2013.01); *F01M 1/12* (2013.01);
(Continued)

(58) Field of Classification Search
CPC . F01M 9/105; F01M 9/106; F01L 1/04; F02B 75/02
See application file for complete search history.

(56) References Cited

U.S. PATENT DOCUMENTS 4,881,496 A * 11/1989 Kronich ..... F01M 9/06 123/196 W
5,031,583 A * 7/1991 Konno ..... F01L 1/267 123/90.16
(Continued)

FOREIGN PATENT DOCUMENTS

CN 2272487 1/1998
CN 1343831 4/2002
(Continued)

OTHER PUBLICATIONS

International Search Report for Application No. PCT/US2014/079236, dated Sep. 1, 2014.

*Primary Examiner* — Zelalem Eshete
(74) *Attorney, Agent, or Firm* — JK Intellectual Property Law, P.A.

(57) ABSTRACT

A four-stroke engine includes an oil tank, a crankshaft chamber, a distribution chamber, a rocker chamber, a combustion chamber, and a lubricating system. The oil tank is communicated with the crankshaft chamber through an oil supply channel. The four-stroke engine further comprises a cam and a transmission mechanism connected between the cam and a crankshaft of the crankshaft chamber in a matched manner. The cam is matched with a rocker of the rocker chamber and located above the combustion chamber.

6 Claims, 4 Drawing Sheets

(51) Int. Cl.

| | |
|---|---|
| ***F01L 1/06*** | (2006.01) |
| ***F01M 1/12*** | (2006.01) |
| ***F01M 11/02*** | (2006.01) |
| ***F01L 1/04*** | (2006.01) |
| ***F02B 75/02*** | (2006.01) |

(52) U.S. Cl.
CPC ..... *F01M 9/106* (2013.01); *F01M 11/02* (2013.01); *F02B 75/02* (2013.01); *F02B 2075/027* (2013.01)

(56) References Cited

U.S. PATENT DOCUMENTS

| | | | | |
|---|---|---|---|---|
| 2002/0020379 | A1* | 2/2002 | Seader ..... | F01L 1/047 123/90.34 |
| 2006/0096564 | A1 | 5/2006 | Sakurai | |
| 2011/0314945 | A1* | 12/2011 | Brandenburg ..... | F16H 61/0031 74/473.11 |

FOREIGN PATENT DOCUMENTS

| | | |
|---|---|---|
| CN | 1944963 | 4/2007 |
| CN | 202788976 | 3/2013 |
| JP | 2011106464 | 6/2011 |

* cited by examiner

FOUR-STROKE ENGINE

CROSS-REFERENCE TO RELATED APPLICATIONS

This application is a national stage of International Application No. PCT/CN2014/079236, filed Jun. 5, 2014, and claims benefit of Chinese Patent Application No. CN 201310239152.2, filed Jun. 17, 2013 all of which are incorporated by reference herein.

The applicant has two other patent applications that can be used as reference for the present application, Chinese Application Nos. CN 201210198826.4 and CN 2013102076373.

TECHNICAL FIELD

The present invention relates to a four-stroke engine.

BACKGROUND

Four-stroke engines have been widely applied to different small tools, for example, hand-held mowers, shearers and other backpack machines. Therefore, besides strict requirements on stability, low vibration and the lubricating system, the engine is also required to be simplified, light and convenient.

Prior four-stroke engines have the following questions: on one hand, the oil pipeline of the lubricating system is complex, which makes processing complex and results in high cost; on the other hand, structures of parts are also complex, which makes engines heavy. For example, the cam chamber of the prior four-stroke engine is separated and far away from the rocker chamber, such that the cam in the cam chamber needs a long metallic tappet to transfer power to the rocker in the rocker chamber. As a result, the rotating tappet vibrates and affects the stability and anti-noise performance of the engine. Moreover, the separated cam chamber and rocker chamber result in more parts, and increased engine weight and high cost.

SUMMARY

To resolve the above problems, the present invention provides an improved four-stroke engine, which has simplified lubricating system, high stability, low noise and simple structure.

In order to achieve the above objectives, the disclosed structure embodied by the following technical solution: a four-stroke engine comprises an oil tank, a crankshaft chamber, a distribution chamber, a rocker chamber, a combustion chamber, and a lubricating system. The oil tank is communicated with the crankshaft chamber through an oil supply channel. The crankshaft chamber is communicated with the distribution chamber through a first oil transmission channel and a unidirectional valve is disposed in the first oil transmission channel. The rocker chamber is communicated with the crankshaft chamber through at least one oil return channel, and a unidirectional valve is disposed in each oil return channel. The distribution chamber is communicated with the oil tank and used for separating an oil-gas mixture into oil mist and fluid oil. The four-stroke engine further comprises a cam and a transmission mechanism connected between the cam and a crankshaft of the crankshaft chamber in a matched manner. The cam is matched with a rocker of the rocker chamber and located above the combustion chamber.

Further aspects may include:

The transmission mechanism comprises a big belt pulley, a small belt pulley, and a belt covered on the big belt pulley and the small belt pulley.

The big belt pulley and the cam are made in one body and able to rotate around a rotation shaft.

The small belt pulley is matched with the crankshaft of the crankshaft chamber.

The transmission mechanism is located inside of the transmission chamber that is communicated with the rocker chamber.

The lubricating system further comprise a second oil transmission channel that is disposed between the distribution chamber and the transmission chamber.

The cam is in direct contact with the rocker.

A unidirectional valve is disposed in the oil supply channel.

Compared with prior art, the present invention has the following advantages: by setting a number of oil supply channels and unidirectional valves in the oil supply channels for the lubricating system, the four-stroke engine in the present invention has simplified lubricating system and better lubricating effect; on the other hand, by setting the cam in the rocker chamber, the engine has simplified structure and high stability, and generates low noise and low vibration.

DETAILED DESCRIPTION OF THE PREFERRED EMBODIMENTS

The following is a nonrestrictive detailed description for the technical proposal of the present invention, in combination with preferable embodiments and drawings.

Figure 1:
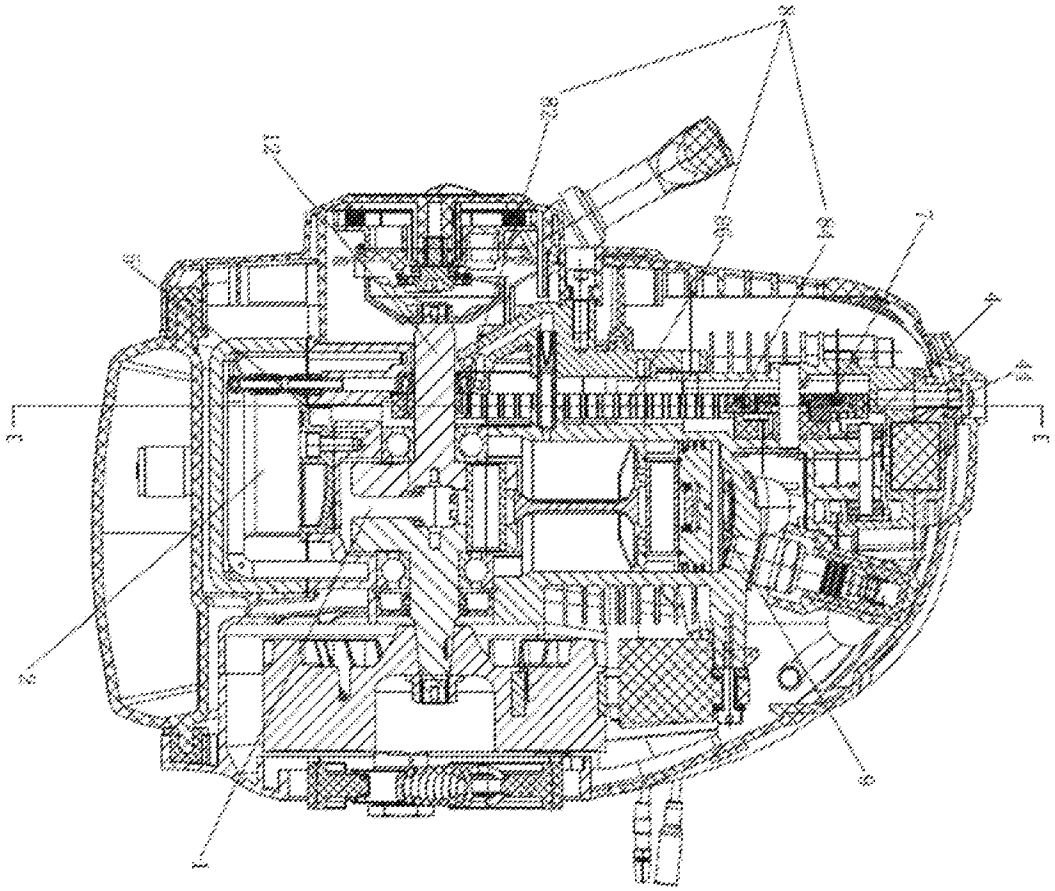
FIG. 1 is a section view of the four-stroke engine for one embodiment of the present invention.
Figure 2:
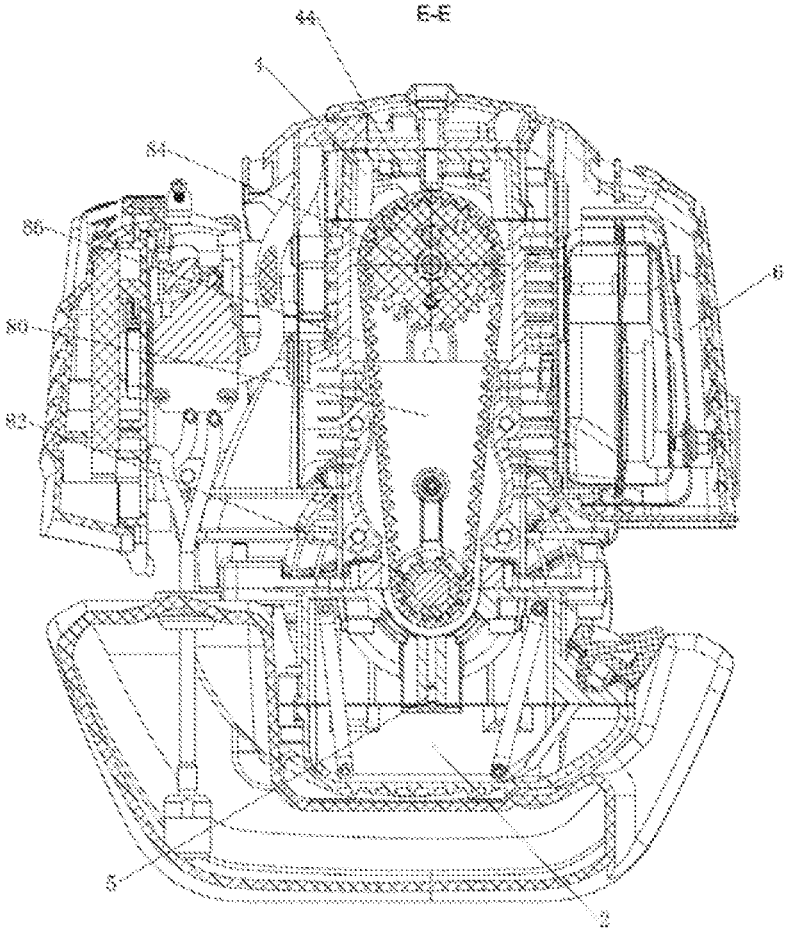
FIG. 2 is a section view of the four-stroke engine of FIG. 1 along the E-E line in FIG. 1.
Figure 3:
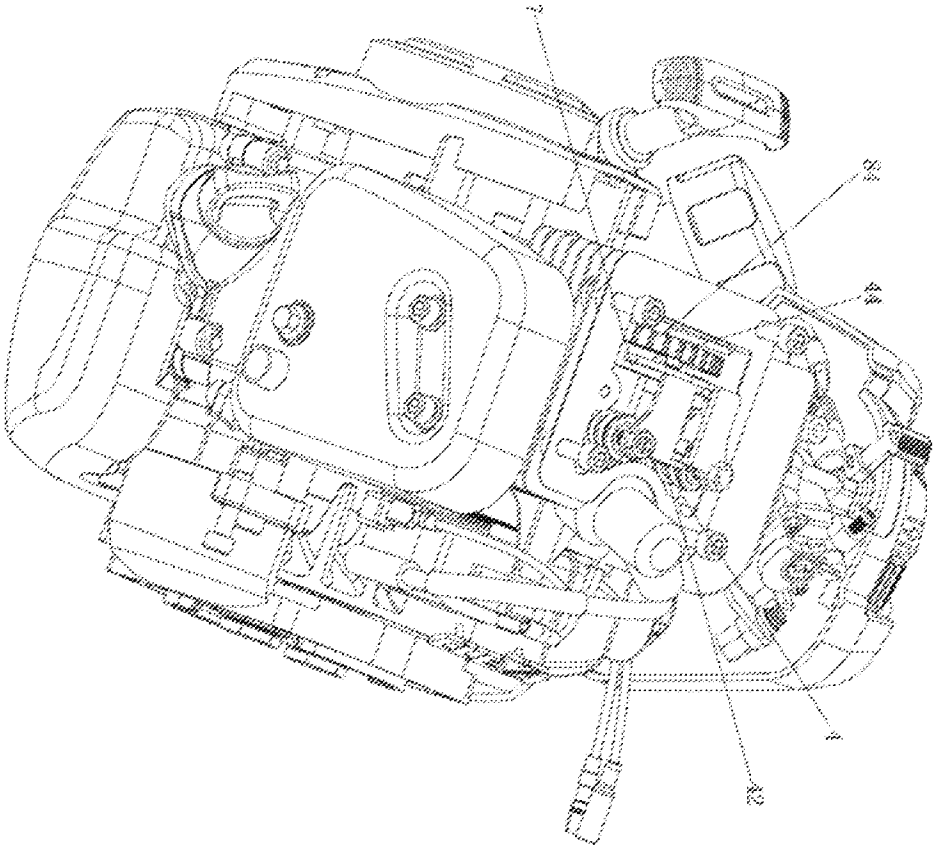
FIG. 3 is an isometric view of the four-stroke engine in FIG. 1.
Figure 4:
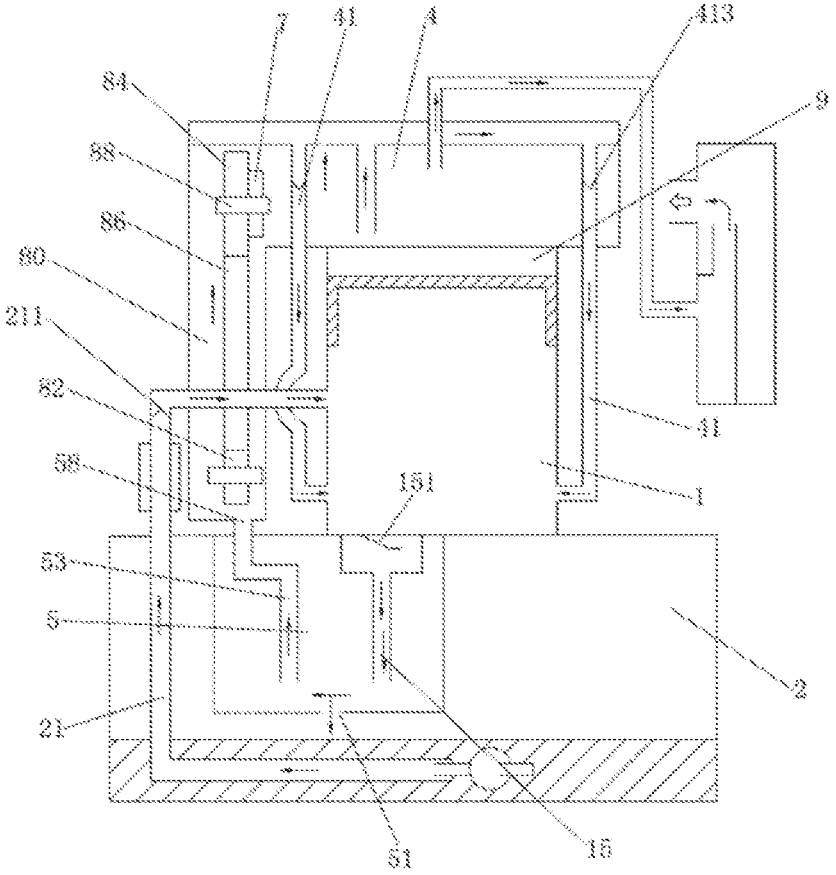
FIG. 4 is a schematic diagram for the whole layout and lubricating system of the four-stroke engine in FIG. 1.

As shown in FIG. 1 to FIG. 4, the four-stroke engine comprises a crankshaft chamber 1, an oil tank 2, a rocker chamber 4, a distribution chamber 5, an air filter 6, a combustion chamber 9 located above the crankshaft chamber 1 and below the rocker chamber 4, and lubricating systems (unnumbered) located among the above components. Structures for the crankshaft chamber 1, the oil tank 2, the distribution chamber 5 and the distribution chamber 6 are similar to Chinese Patent Application Nos. CN201210198826A and CN2013102076373, thus the detailed description is omitted here. The following is a detailed explanation for the present subject matter.

The four-stroke engine further comprises a cam 7 and a transmission mechanism 8 disposed between the cam and the crankshaft chamber 1. The transmission mechanism 8 comprises a small belt pulley 82, a big belt pulley 84, and a belt 86 covered on the big belt pulley 84 and the small belt pulley 82. The cam 7 and the big belt pulley 84 are made in one body and sleeved on a rotation shaft 88, and the cam 7 is located above the combustion chamber 9, which means that the cam 7 is disposed on the top. It is also feasible to manufacture the cam 7 and the big belt pulley 84 separately. The transmission mechanism 8 is located in the transmission chamber 80 and communicated with the rocker chamber 4. A rocker rotation shaft 42 and a rocker 44 on the rocker rotation shaft 42 are disposed in the rocker chamber 4. Because the cam 7 in the present invention is disposed on the top, the cam contacts the rocker 44 directly to transfer power, so the tappet in prior art designs is not needed. Thus, the power is transferred from crankshaft 12 to cam 7 through the transmission mechanism 8, and the cam 7 transfers the power to rocker 44 to turn on and off the valve. Therefore, by setting the cam 7 above the combustion chamber 9, the cam chamber in prior art is not needed, and the structure is simplified. The direct contact between the cam 7 and the rocker 44 eliminates the negative effect of using a tappet, and results in high stability, good anti-noise performance and low vibration.

The lubricating system is similar to the two referenced patent applications, comprising an oil supply channel 21 disposed between the oil tank 2 and the crankshaft chamber 1, a unidirectional valve 211 inside of the oil supply channel 21, a first oil transmission channel 15 disposed between the crankshaft chamber 1 and the distribution chamber 5, a unidirectional valve 151 disposed in the first oil transmission channel 15, the distribution chamber 5 being communicated with the oil tank 2 and used for separating an oil-gas mixture into oil mist and fluid oil 51, a second oil transmission channel 53 disposed between the distribution chamber 5 and the transmission chamber 80, at least one oil return channel 41 disposed between the rocker chamber 4 and the crankshaft chamber 1, and a unidirectional valve 413 disposed in the at least one oil return channel 41. If desired, there can be two oil return channels 41 that are roughly in parallel with each other. The lubricating system provided by the present invention, by reasonably disposing the oil channels 21, 15, 53 and 41, each of which is provided with a unidirectional valve inside, has a simple structure and better lubricating effect. The lubricating system can retain good lubricating effect at any, position, and further reduce pollutant emission and manufacturing cost.

It must be noted that the above preferable embodiment is intended to explain the technical concept and feature of the present invention, so that those skilled in the art can understand and implement the present invention. However, the embodiment does not restrict the protective scope of the present invention. All equivalent changes or modifications based on the technical concept of the present invention shall belong to the protective scope of the present invention.

The invention claimed is:

1. A four-stroke engine comprises:

an oil tank;

a crankshaft chamber;

a distribution chamber;

a rocker chamber;

a transmission chamber in communication with the rocker chamber;

a combustion chamber; and a lubricating system;

the oil tank being communicated with the crankshaft chamber through an oil supply channel;

the crankshaft chamber being communicated with the distribution chamber through a first oil transmission channel, and a unidirectional valve being disposed in the first oil transmission channel;

the distribution chamber being communicated with the oil tank and used for separating an oil-gas mixture into oil mist and fluid oil;

the transmission chamber and the rocker chamber being sequentially communicated with the distribution chamber via a second oil transmission channel;

the rocker chamber being communicated with the crankshaft chamber through at least one oil return channel, and a unidirectional valve is being disposed in each oil return channel;

the four-stroke engine further including a cam and a transmission mechanism in the transmission chamber connected between the cam and a crankshaft of the crankshaft chamber in a matched manner so that the cam is driven by the crankshaft via the transmission mechanism, the cam driving a rocker of the rocker chamber and being located above the combustion chamber.

2. The four-stroke engine according to claim 1, wherein the transmission mechanism comprises a big belt pulley, a small belt pulley, and a belt driven by the big belt pulley and the small belt pulley.

3. The four-stroke engine according to claim 2, wherein the big belt pulley and the cam are made in one body and are rotatable around a rotation shaft.

4. The four-stroke engine according to claim 2, wherein the small belt pulley is matched with the crankshaft of the crankshaft chamber.

5. The four-stroke engine according to claim 1, wherein the cam is direct contact with the rocker.

6. The four-stroke engine according to claim 1, wherein a unidirectional valve is disposed in the oil supply channel.

* * * * *